US006256883B1

(12) United States Patent
Kinoshita

(10) Patent No.: US 6,256,883 B1
(45) Date of Patent: Jul. 10, 2001

(54) METHOD OF PRODUCING NOZZLE PLATE FOR USE IN INK JET PRINTER

(75) Inventor: Makoto Kinoshita, Tottori (JP)

(73) Assignee: Ricoh Microelectronics Company, Ltd., Tottori (JP)

( * ) Notice: Subject to any disclaimer, the term of this patent is extended or adjusted under 35 U.S.C. 154(b) by 0 days.

(21) Appl. No.: 09/321,603

(22) Filed: May 28, 1999

(30) Foreign Application Priority Data

May 29, 1998 (JP) ..... 10-166266

(51) Int. Cl.[7] ..... B21D 53/76; D01D 5/14

(52) U.S. Cl. ..... 29/890.1; 29/527.5; 29/417; 427/357; 427/175; 264/210.8; 264/211.22; 205/158; 205/164; 347/47

(58) Field of Search ..... 29/890.1, 890.09, 29/25.35, 527.5, 527.6, 417, 423, 896.6; 427/357, 175; 264/210.8, 211.22, 177.16, 177.17; 205/158, 164; 347/47

(56) References Cited

U.S. PATENT DOCUMENTS

| | | | | |
|---|---|---|---|---|
| 4,301,585 | * | 11/1981 | Ikeda | 29/890.1 |
| 4,429,322 | | 1/1984 | Dressler et al. . | |
| 4,639,396 | * | 1/1987 | Semsarzadeh | 264/210.8 |
| 5,055,248 | * | 10/1991 | Motooka et al. | 264/210.8 |
| 5,454,163 | | 10/1995 | McDonald et al. . | |
| 5,773,536 | * | 6/1998 | Mizoguchi et al. | 205/164 |
| 5,937,521 | * | 8/1999 | March et al. | 29/417 |

FOREIGN PATENT DOCUMENTS

| | | | | |
|---|---|---|---|---|
| 1 392 776 | | 4/1975 | (GB) . | |
| 3-110120 | * | 5/1991 | (JP) | 264/211.2 |
| 3-190717 | * | 5/1991 | (JP) | 264/211.2 |
| 6-99581 | * | 5/1991 | (JP) | 29/890.1 |
| 7-216709 | | 8/1995 | (JP) . | |
| 7-314669 | * | 12/1995 | (JP) | 29/890.1 |

* cited by examiner

*Primary Examiner*—S. Thomas Hughes
*Assistant Examiner*—A. Dexter Tugbang
(74) *Attorney, Agent, or Firm*—Oblon, Spivak, McClelland, Maier & Neustadt, P.C.

(57) ABSTRACT

A method of producing a nozzle plate for use in an ink jet head includes the steps of (a) stretching a predetermined number of resin lines, each having a cross section corresponding in shape to each nozzle hole to be formed in an ink jet head, in the same arrangement as that of nozzle holes to be formed in the ink jet head, (b) plating the peripheral surface of each of the resin lines with a metal, while maintaining the arrangement of the resin lines, (c) forming a nozzle substrate so as to include the resin lines therein with the metal used in the plating of the resin lines, (d) slicing the nozzle substrate, and (e) removing the resin lines from the sliced nozzle substrate, thereby forming the nozzle plate. In the above method, the resin lines can be removed from the nozzle substrate, and then the nozzle substrate can be sliced so as to form the nozzle plate.

23 Claims, 5 Drawing Sheets

METHOD OF PRODUCING NOZZLE PLATE FOR USE IN INK JET PRINTER

BACKGROUND OF THE INVENTION

1. Field of the Invention

The present invention relates to a method of producing a nozzle plate, more particularly to a nozzle plate having nozzle holes with an extremely small diameter, with high mechanical strength and excellent water and ink repellency, for an ink jet head for use in an ink jet printer.

2. Discussion of Background

As conventional ink jet heads, there are known a bubble jet type ink jet head and a pressure application type ink jet head. In an ink jet head of the bubble jet type, bubbles are formed, using an exothermic heating element such as a thermal head disposed in an ink passage of an ink reservoir, which is connected to the nozzle holes of the ink jet head, so that an appropriate amount of the ink is ejected from the nozzle holes by the pressure applied to the ink by the bubbles, while in an ink jet head of the pressure application type, pressure is externally applied in a pulse-like manner to the ink filled in the ink reservoir, using pressure application means such as a piezo-electric element, so that an appropriate amount of the ink is ejected from the nozzle holes by the pressure applied to the ink by the pressure application means.

For producing the nozzle plates for use in such ink jet heads, many methods have been proposed, for instance, in Japanese Laid-Open Patent Application 6-99581 and Japanese Laid-Open Patent Application 7-314669, which respectively disclose an invention entitled "Method of Producing Nozzle Plate" and an invention entitled "Ink Jet Recording Head and Method of Producing the same".

As working methods for forming the nozzle holes in the above-mentioned nozzle plates, there are known, for instance, an injection molding method using a resin as a injection molding material, a punch press working method using a punch and a die, an etching method and an additive method which are known as methods of producing mainly nozzles made of metallic materials, and an abrasion method for working resins such as polyimide, polycarbonate, polysulfone, polyethersulfone, and polypropylene, by ultraviolet irradiation, for instance, using excimer laser beam.

When the nozzle holes are formed in the nozzle plate, for instance, by the injection molding method or the punch press working method, the edges of the nozzle holes tend to be rounded or to become blunt, or burrs are formed at the edges, or the worked surface is rough, so that the surface of the nozzle plate worked by these methods has poor ink and water repellency and therefore the ink tends to stick to the surface of the nozzle plate or the nozzle holes tend to be clogged with the ink.

Furthermore, there is a lower limit to a minimum diameter of the nozzle holes that can be made by these methods, since there is a limit to both the minimum size of the holes in the metal mold and the minimum diameter of the punch that can be used in the above methods. To be more specific, it is extremely difficult to form nozzle holes with an inner diameter as small as several microns by the above methods.

In the above-mentioned etching method or the additive method, many treatment and processing steps are required, and after the nozzle holes are formed, mirror polishing of the nozzle plate surface, or a secondary treatment such as nickel.teflon composite plating has to be performed in order to improve the water repellency of the surface of the nozzle plate, so that the production cost of the nozzle plate is high.

The abrasion method using the excimer laser has a significant advantage over other methods that shavings or powder-like turnings are not formed in the course of the working process. However, in the case of the abrasion method using the excimer laser, the edge portions of the worked nozzle holes on the ink ejection side tend to be slightly rounded although the extent thereof differs more or less depending upon the intensity and the duration of the irradiation of the nozzle formation surface with the ultraviolet light.

Even in the case of the nozzle holes worked in the nozzle plate by the above-mentioned abrasion method using the excimer laser, the nozzle holes and the nozzle plate have so poor water repellency that the nozzle holes on the ink ejection side tend to be clogged with the ink which sticks to the surface of the nozzle plate, in the same manner as in the case of the nozzle holes worked by the above-mentioned other methods.

Furthermore, as mentioned above, in the case of the abrasion method using the excimer laser, resins such as polyimide, polycarbonate, polysulfone, polyethersulfone, and polypropylene, are used in the form of a relatively thin plate in order to facilitate the abrasion working thereof using the excimer laser, so that the nozzle plate made by the abrasion method using the excimer laser has less mechanical strength than that of a nozzle plate made of a metal.

SUMMARY OF THE INVENTION

It is therefore an object of the present invention to provide a method capable of producing a nozzle plate having nozzle holes with an extremely small diameter, with high mechanical strength and excellent water and ink repellency, for an ink jet head for use in an ink jet printer.

The above object of the present invention can be achieved by a method of producing a nozzle plate for use in an ink jet head, comprising the steps of (a) stretching a predetermined number of resin lines, each having a cross section corresponding in shape to each nozzle hole to be formed in an ink jet head, in the same arrangement as that of the nozzle holes to be formed in the ink jet head, (b) plating the peripheral surface of each of the resin lines with a metal, while maintaining the arrangement of the resin lines, (c) forming a nozzle substrate so as to include the resin lines therein with the metal used in the plating of the resin lines, (d) slicing the nozzle substrate, and (e) removing the resin lines from the sliced nozzle substrate, thereby forming the nozzle plate.

In the above method, the resin lines may be removed from the nozzle substrate, and then the nozzle substrate may be sliced so as to form the nozzle plate.

Furthermore, in the above method, there may be constructed a die comprising (a) a resin plate in which through-holes for extruding the resin lines therefrom are formed so as to correspond to the nozzle holes of the ink jet head in terms of the number, the shape and the arrangement thereof, and (b) a resin plate support for supporting the resin plate when the resin lines are extruded from the through-holes of the resin plate, the resin plate support having openings corresponding to the through-holes formed in the resin plate in terms of the number and the arrangement thereof, with the same as or greater than the size of the through-holes formed in the resin plate, and a viscous resin is extruded from the die to prepare the predetermined number of the resin lines en bloc.

Furthermore, the resin plate and the resin plate support may be constructed so as to be separable from each other in the above method, with the inclusion of a further step of depositing an electroconductive metal film in vacuum on the surface of the resin lines prior to the step of plating the peripheral surface of each of the resin lines with the metal, while the predetermined number of the resin lines is stretched between the resin plate and the resin plate support.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
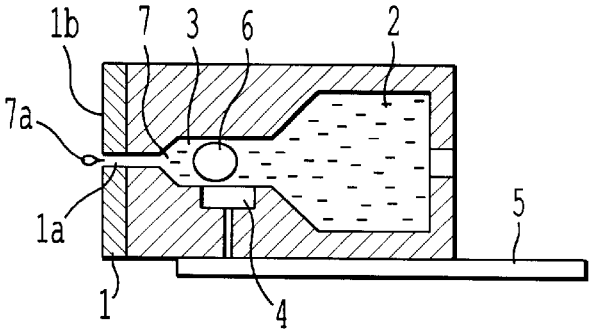
FIG. 1 is a schematic cross-sectional view of an example of an ink jet head of a bubble jet type, using a thermal head.

The method of producing a nozzle plate for use in an ink jet head according to the present invention comprises the steps of (a) stretching a predetermined number of resin lines, each having a cross section corresponding in shape to each nozzle hole to be formed in an ink jet head, in the same arrangement as that of the nozzle holes to be formed in the ink jet head, (b) plating the peripheral surface of each of the resin lines with a metal, while maintaining the arrangement of the resin lines, (c) forming a nozzle substrate so as to include the resin lines therein with the metal used in the plating of the resin lines, (d) slicing the nozzle substrate, and (e) removing the resin lines from the sliced nozzle substrate, thereby forming the nozzle plate.

In the above method, the resin lines may be removed from the nozzle substrate, and then the nozzle substrate may be sliced so as to form the nozzle plate.

The resin lines for use in the above method, for instance, rod-shaped resin lines with a round cross-section corresponding to the cross section of each of the nozzle holes to be formed in the nozzle plate, can be easily stretched to prepare resin lines with an external diameter as desired, for instance, with a thin external diameter in the order of several microns, while maintaining the shape of the cross section thereof.

In the method of the present invention, a predetermined number of extremely thin resin lines prepared as mentioned above are stretched in the same arrangement as that of the desired nozzle holes to be formed in the ink jet head, and if necessary, the resin lines are further stretched to make the resin lines thinner and also to increase the strength of the resin lines.

The peripheral surface of each of the resin lines is then plated with a metal, while maintaining the arrangement of the resin lines, so that a nozzle substrate is formed with the metal used in the plating of the resin lines so as to include the resin lines in the nozzle substrate.

The nozzle substrate is then sliced, and the resin lines are removed from the sliced nozzle substrate, thereby forming the nozzle plate. Alternatively, the resin lines are removed from the nozzle substrate, and then the nozzle substrate is sliced so as to form the nozzle plate. Thus, a nozzle plate with the nozzle holes with the desired diameter and arrangement can be obtained.

In the method of producing the nozzle plate of the present invention, the diameter of the resin lines for forming the nozzle holes in the nozzle plate can be minimized as desired, and the arrangement of the resin lines can also be set as desired, so that, for example, nozzle holes with an inner diameter of several microns in the desired arrangement can be easily formed en bloc.

Furthermore, the nozzle substrate is made of the metal used in the plating of the resin lines, and the thickness of the nozzle plate can be chosen as desired when the nozzle substrate is sliced, so that the mechanical strength and the shape precision of the obtained nozzle plate are extremely high.

Furthermore, since the nozzle substrate is sliced, the edge portions of the nozzle holes of the nozzle plate are not rounded, but are formed at substantially right angles, so that the ejection of the ink from the nozzle holes can be performed in an improved clear-cut manner.

In the above method, there may be constructed a die comprising (a) a resin plate in which through-holes for extruding the resin lines therefrom are formed so as to correspond to the nozzle holes of the ink jet head in terms of the number, the shape and the arrangement thereof, and (b) a resin plate support for supporting the resin plate when the resin lines are extruded from the through-holes of the resin plate, the resin plate support having openings corresponding to the through-holes formed in the resin plate in terms of the number and the arrangement thereof, with the same as or greater than the size of the through-holes formed in the resin plate, and a viscous resin is extruded from the die to prepare the predetermined number of the resin lines en bloc.

In the above method, the resin lines can be formed, using the die constructed as mentioned above. The die for the formation of the resin lines can be constructed with resin materials that can be easily worked and are inexpensive.

Furthermore, by use of the resin plate as the above-mentioned die, the through-holes corresponding to the nozzle holes in terms of the cross section thereof can be formed relatively easily in the resin plate by the abrasion method using the excimer laser.

Furthermore, by use of the above-mentioned die constructed of (a) the resin plate and (b) the resin plate support for supporting the resin plate, the mechanical strength of the resin plate can be significantly improved against the pressure applied thereto by the viscous resin when the viscous resin is extruded from the die for the preparation of the resin lines and the predetermined number of the resin lines can be easily prepared en bloc.

Furthermore, in the above-mentioned method, the resin plate and the resin plate support may be constructed so as to be separable from each other in the above method, and there may be provided a further step of depositing an electroconductive metal film in vacuum on the surface of the resin lines prior to the step of plating the peripheral surface of each of the resin lines with the metal, while the predetermined number of the resin lines is stretched between the resin plate and the resin plate support.

In the above-mentioned method, the resin lines are stretched between the resin plate and the resin plate support, while the posture of the resin lines at the time of the formation of the resin lines by the die is maintained.

According to this method, once the number and the arrangement of the through-holes to be formed in the resin plate of the die is set so as to correspond to the number and the arrangement of the nozzle holes to be formed in the nozzle plate, the labor of rearranging the resin lines formed by the die is unnecessary, and an equipment therefor is also unnecessary, which is a significant timesaving.

The metal nozzle plate formed by the above-mentioned method can also be used as the die for forming the resin lines for use in the present invention.

When the metal nozzle plate formed by the above-mentioned method is used as the die for forming the resin lines, the life of the die can be prolonged. Further, by use of the metal nozzle plate as the die for forming the resin lines, the resin lines extruded from the die can be easily stretched as the resin lines are being extruded, so that the strength of the resin lines can be increased while the diameter of the resin lines is decreased.

In the present invention, as mentioned above, the nozzle substrate is sliced, and then the resin lines are removed from the sliced nozzle substrate, thereby forming the nozzle plate. Alternatively, the resin lines can be removed from the nozzle substrate, and then the nozzle substrate can be sliced so as to form the nozzle plate.

In the case where the nozzle substrate is sliced, and then the resin lines are removed from the sliced nozzle substrate, the sliced nozzle substrates are in such a state that the resin lines are embedded in the nozzle substrates. Therefore, the nozzle holes free of burrs can be formed when the nozzle substrate is sliced.

The present invention can also be carried out by the following method:

A method of producing a nozzle plate having a predetermined number of through-holes with a predetermined cross section in a predetermined arrangement, comprising the steps of:

stretching the same number of resin lines as that of the through-holes to be formed in the nozzle plate, each having a cross section in the same shape as that of the cross section of the through-holes to be formed in the nozzle plate, in the same arrangement as that of the through-holes to be formed in the nozzle plate, with each of the resin lines being out of contact with each other, making at least the surface of the resin lines electroconductive with the arrangement of the resin lines being maintained, plating the surface of the resin lines with a metal to grow the plating with the metal until a nozzle substrate in which the resin lines are embedded therein is formed, slicing the nozzle substrate so as to prepare sliced nozzle substrates in which sliced resin lines are embedded, and removing the sliced resin lines from the sliced nozzle substrates, thereby forming the nozzle plate.

In the above method, the resin lines can be formed by extruding a viscous resin from a die having the same number of through-holes with a cross section in the same shape as those of the through-holes to be formed in the nozzle plate in the same predetermined arrangement.

Furthermore, as mentioned above, the die may comprises:

a resin plate having the same number of through-holes with a cross section in the same shape as those of the through-holes to be formed in the nozzle plate in the same predetermined arrangement, and a resin plate support for supporting the resin plate when the resin lines are extruded from the through-holes of the resin plate, the resin plate support having openings corresponding to the through-holes formed in the resin plate in terms of the number and the arrangement thereof, having a diameter with the same as or greater than the diameter of the through-holes formed in the resin plate.

In the above method, the resin plate and the resin plate support may be constructed to as to be separable from each other and so as to be positioned in such a posture that the resin lines can be stretched between the resin plate and the resin plate support.

Furthermore, the die can be composed of or comprises the nozzle plate as produced by the above-mentioned method.

In the above method, at least the surface of the resin lines can be made electroconductive by depositing an electroconductive material thereon such as an electroconductive metal, for instance, by vacuum deposition thereof.

The sliced resin lines can be removed from the sliced nozzle substrates by burning.

The above-mentioned method may further comprise a step of subjecting the nozzle plate to heat treatment in an atmosphere of oxygen or in an atmosphere of nitrogen.

In the above method, it is preferable to use titanium (Ti) as the electroconductive metal, and as the metal used for plating the surface of the resin lines, metals such as Ni and Al can be employed.

Furthermore, in the above-mentioned method, there can be employed resin lines with at least the surface thereof being electroconductive, for instance, made of an electroconductive material such as an electroconductive resin, an electroconductive material containing material, and conventional materials having the above-mentioned electroconductive properties. In this case, the surface of the resin lines can be directly plated with a metal.

Other features of this invention will become apparent in the course of the following description of exemplary embodiments, which are given for illustration of the invention and are not intended to be limiting thereof.

An example of the method of producing the nozzle plate for an ink jet head for use in an ink jet printer of the present invention will now be explained with the accompanying drawings.

FIG. 1 is a schematic cross-sectional view of an example of a bubble jet type ink jet head, using an exothermic heating element such as a thermal head.

In the ink jet head as shown in FIG. 1, an exothermic heating element 4 such as a thermal head is disposed at an ink passage 3 of an ink reservoir 2, which is connected to a nozzle hole 1*a* formed in a nozzle plate 1. When the exothermic heating element 4 is selectively caused to generate heat based on predetermined image data provided by a driving circuit 5, a bubble 6 is formed in the ink passage 3. When the bubble 6 grows, since the ink reservoir 2 is tightly sealed, a predetermined amount of an ink 7 within the ink passage 3 is ejected in the form of an ink droplet 7*a,* together with the bubble 6, from the nozzle hole 1*a,* and is flipped by the bubble 6 and then caused to travel toward a recording sheet (not shown) which is disposed so as to face an ink ejection surface 1*b* of the ink jet head, and is deposited on a predetermined image element formation area on the recording sheet.

Figure 2:
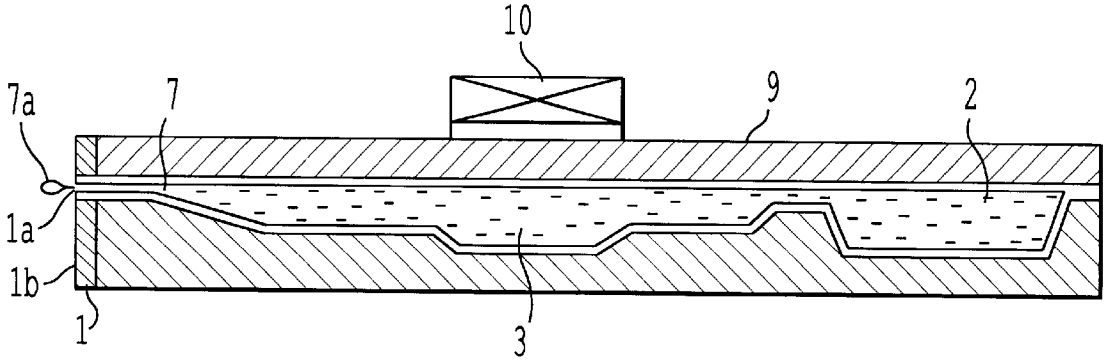
FIG. 2 is a schematic cross-sectional view of an example of an ink jet head of a pressure application type using a piezo-electric element.

FIG. 2 is a schematic cross-sectional view of an example of a pressure-application type ink jet head, using a piezo-electric element.

In the ink jet head shown in FIG. 2, a piezo-electric element 10 is disposed at a vibrator plate 9 which forms an ink passage 3 of an ink reservoir 2. The ink passage 3 is connected to a nozzle hole 1*a* formed in a nozzle plate 1. When the piezo-electric element 10 is selectively driven based on predetermined image data, the vibrator plate 9 is depressed by the piezo-electric element 10. Since the vibrator 9 is depressed and the ink reservoir 2 is tightly sealed, a predetermined amount of an ink 7 within the ink passage 3 is ejected in the form of an ink droplet 7*a* from the nozzle hole 1*a,* and is caused to travel toward a recording sheet (not shown) which is disposed so as to face an ink ejection surface 1*b* of the ink jet head, and is then deposited on a predetermined image element formation area on the recording sheet in the same manner as in the case of the bubble jet type ink jet head.

FIGS 3A, 3B, 3C, 3D and 3E schematically show a procedure of producing a nozzle plate 1 of the present invention.

Figure 3A:
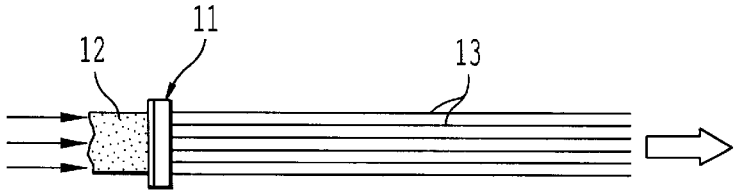
FIGS. 3A to 3E are diagrams for explaining a series of processes for producing a nozzle plate by the method of the present invention.

In producing the nozzle plate 1, to begin with, resin lines 13 are formed by extrusion of a viscous resin 12 through a die 11 as shown in FIG. 3A.

Figure 4:
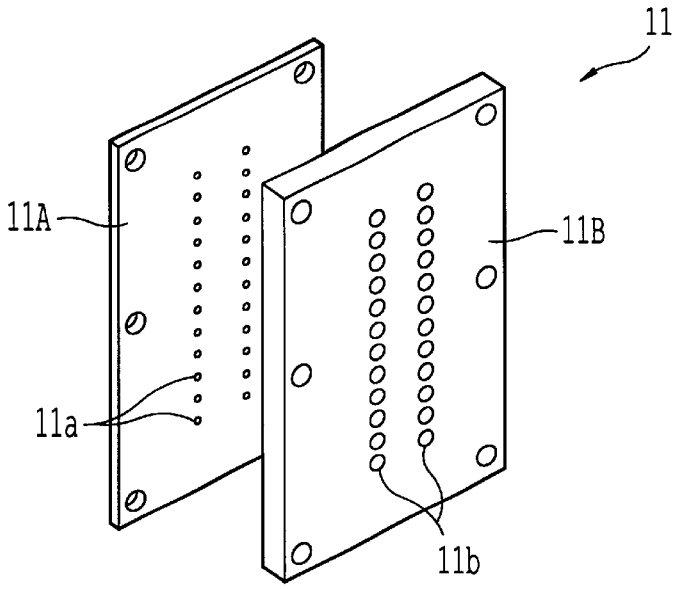
FIG. 4 is a schematic perspective view of a die for extruding resin lines therefrom, which is employed in the processes for producing the nozzle plate by the method of the present invention.
Figure 5:
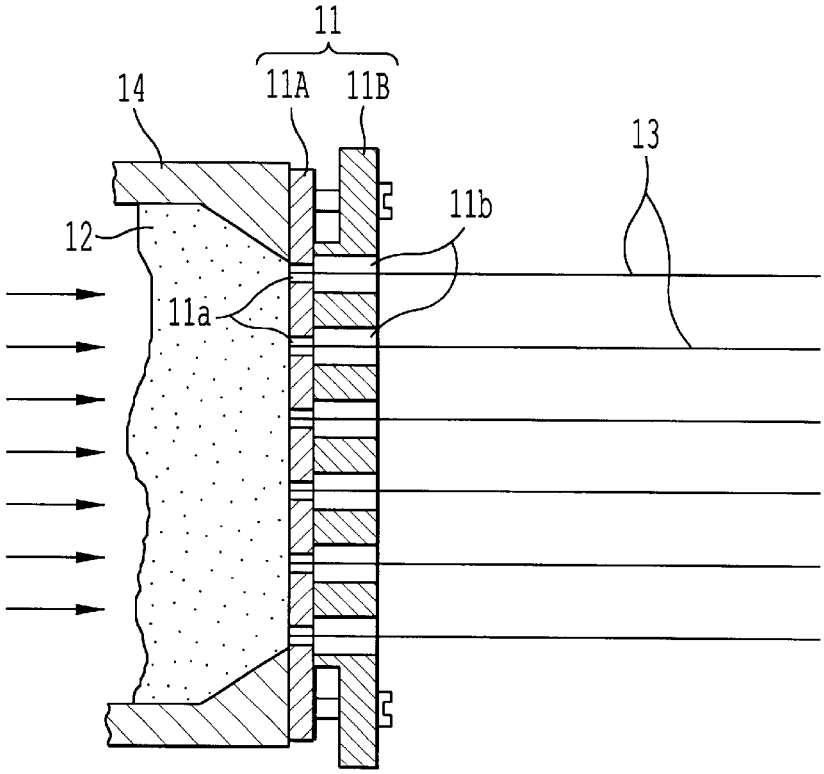
FIG. 5 is a schematic cross-sectional view of the above-mentioned die which is attached to a resin molding apparatus and from which the above-mentioned resin lines are extruded.

The above-mentioned die 11 is composed of (a) a resin plate 11A with through-holes 11*a* through which the above-mentioned viscous resin 12 is to be extruded, and (b) a resin plate support 11B for supporting the resin plate 11A when forming the resin lines 13 by extruding the above-mentioned viscous resin 12 through the through-holes 11*a* formed in the resin plate 11A, with openings 11*b* having a diameter which is the same as or greater than the diameter of the through-holes 11*a* being formed in the resin plate support 11*b* so as to correspond in position to the through-holes 11 formed in the resin plate 11A as shown in FIG. 4 and FIG. 5. In FIG. 5, reference numeral 14 indicates a resin molding apparatus.

It is preferable that the through-holes 11*a* of the resin plate 11A be formed by abrasion working, using laser beams, for example, laser beams of excimer laser.

When the abrasion working using such laser beams is employed, the through-holes 11 with a cross-section in a predetermined shape, with a small inner diameter in a range of several microns, can be formed relatively easily in a predetermined arrangement thereof in the resin place 11A as desired, without forming burrs or the like.

Any resin material can be used as the material for the resin plate 11A, but it is preferable that polyimide be employed since it is suitable for the above-mentioned abrasion working using excimer laser.

Figure 6:
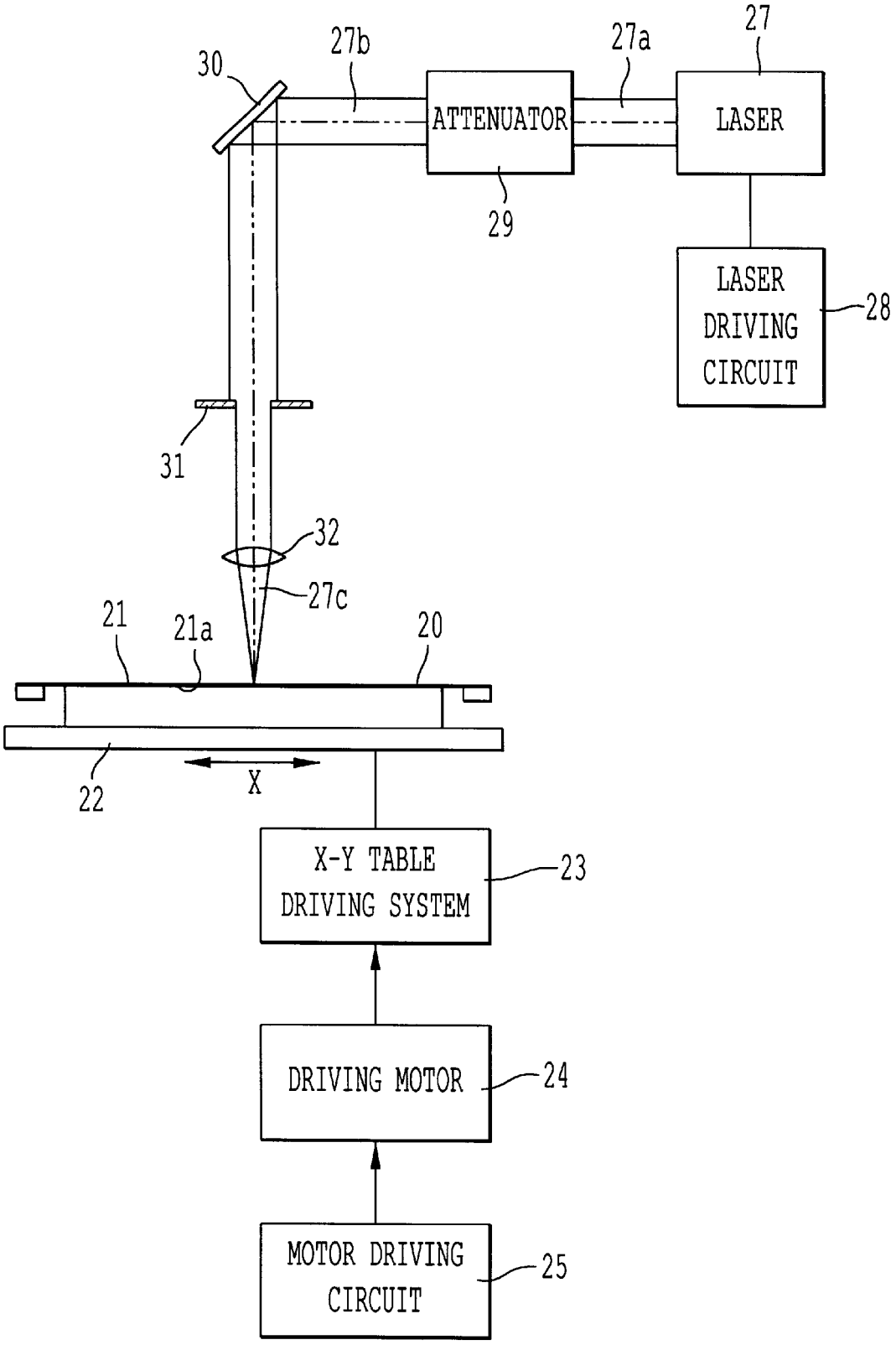
FIG. 6 is a diagram of an example of a laser working apparatus for forming through-holes in a resin plate for use in the above-mentioned die.

FIG. 6 is a schematic diagram showing an example of a laser working apparatus for forming the through-holes 11*a* in a predetermined arrangement and with a predetermined number as desired in the above-mentioned resin plate 11A.

As shown in FIG. 6, a work 20 from which the above-mentioned resin plate 11A is to be formed is placed on a work setting base 21 having a substantially horizontal work setting surface 21*a*. The work setting base 21 is placed on an X-Y table 22 which is capable of moving the work setting surface 21*a* in both an X direction and a Y direction of a horizontal plane normal to the plane of FIG. 6.

The X-Y table 22 can be driven in the X-Y directions by a driving motor 24 comprising a servomotor (which may be replaced by a stepping motor) via an X-Y table driving system 2 comprising, for instance, a ball shaft and a linear motor. The driving motor 24 is driven by a motor driving circuit 25 which supplies driving power to the driving motor 24 in accordance with driving instructions input from a driving control apparatus (not shown).

An excimer laser 27 generates a laser beam 27*a* with a working frequency by a laser driving circuit 28 for driving the excimer laser 27 based on a driving trigger with a predetermined frequency (normally 200 Hz). The working frequency of the laser beam 27*a* is based on the above-mentioned frequency.

The laser beam 27*a* generated from the above excimer laser 27 is changed to a laser beam 27*b* so as to have an energy density suitable for working the work 20 by an attenuator 29.

The optical path of the laser beam 27*b* with the energy density thereof being adjusted by the attenuator 29 is changed by a reflecting mirror 30 for changing the irradiation optical path of the laser beam 27*b* in such a manner that the laser beam 27*b* impinges on the surface of the work 20 to be worked with a substantially right incident angle thereon.

An aperture mask 31 is irradiated with the laser beam 27*b* of which optical path is changed by the reflecting mirror 30.

The aperture mask 31 is composed of a stainless steel plate having excellent heat resistance and abrasion resistance to the irradiation by the above-mentioned laser beam 27*b*, or a glass plate and a dielectric multi-layer film made of, for instance, silicon dioxide or hafnium oxide, in a reflecting pattern, provided on the glass plate. In the aperture mask 31, one or more transmission holes are formed in advance, in a working pattern to be formed in the above-mentioned work 20, which is or are similar in shape to the through-holes 11*a* of the resin plate 11A.

When the working pattern formed in the aperture mask 31 is irradiated with the laser beam 27*b,* the laser beam 27*b* is focused so as to form the working pattern with a predetermined size on the surface of the work 20 to be worked (hereinafter referred to as the working surface of the work 20) through a condenser lens 32.

The laser beam thus focused by the condenser lens 32 is hereinafter referred to as the laser beam 27*c*. The work 20 is moved by the X-Y table 22 in such a manner that a predetermined working portion on the working surface of the work 20 comes to an irradiation position of the laser beam 27*c,* and then the working surface of the work 20 is irradiated with the laser beam 27*c* in this manner, whereby a predetermined number of through-holes in the shape corresponding to the working pattern in the aperture mask 31 are formed in the work 20.

Figure 7A:
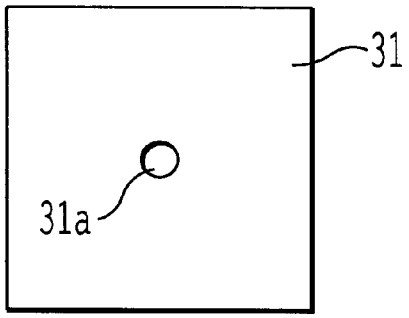
FIGS. 7A and 7B are plan views of examples of aperture masks for use in the above-mentioned laser working apparatus, in which aperture masks there is formed one or more transmission holes with a working pattern corresponding to the through-holes to be formed in the resin plate.
Figure 7B:
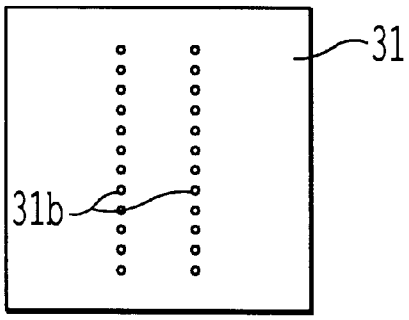

As the above-mentioned aperture mask 31, there can employed either (a) an aperture mask 31 provided with a working pattern including a single transmission hole 31*a* corresponding in shape to the through-hole 11*a* to be formed in the above-mentioned resin plate 11A as shown in FIG. 7, or (b) an aperture mask 31 provided with a working pattern including a plurality of transmission holes 31*b* with a predetermined arrangement, corresponding to the through-holes 11*a* to be formed with a predetermined arrangement in the above-mentioned resin plate 11A as shown in FIG. 7(*b*).

In the case where the aperture mask 31 provided with the working pattern including the single transmission hole 31*a* is used, a predetermined number of through-holes are made in the work 20 as the work 20 is moved for each through-hole on the X-Y table 22. In this case, the through-holes are made in the work 20 one by one, so that this method has a shortcoming that it takes time for the working, but has the advantages that a large working pattern can be made and that the working precision for the formation of the through-holes in the work 20 can be improved.

On the other hand, in the case where the aperture mask 31 provided with the working pattern including a plurality of transmission holes 31*b* with a predetermined arrangement as shown in FIG. 7(*b*) is used, a predetermined number of through-holes can be formed en bloc in the work 20, so that the working time for the work 20 can be shortened.

The thus formed resin plate 11A is attached as die to a resin extruding portion of the resin molding apparatus 14 from which the viscous resin 12 is to be extruded.

Since the resin plate 11A is made of a resin, there is a risk that the resin plate 11A is broken by the pressure applied thereto by the above-mentioned viscous resin 12 when the viscous resin 12 is extruded with the application of pressure thereto.

Therefore, when the viscous resin 12 is extruded with the application of pressure thereto, there is attached to the resin plate 11A at the resin extruding portion of the resin molding apparatus, the resin plate support 11B for supporting the resin plate 11A. In the resin plate support 11B, openings 11*b* are formed so as to correspond to the through-holes 11*a* formed in the resin plate 11A in terms of the positions thereof, and have such a size that is the same as or greater than the size of the through-holes 11*a* formed in the resin plate 11A. Thus, the resin plate 11A is held between the resin extruding portion of the resin molding apparatus 14 and the resin plate support 11B, whereby the resin plate 11A can keep its proper position against the pressure applied thereto by the viscous resin 12 when the viscous resin 12 is extruded.

The resin lines 13 are formed by extruding the viscous resin 12 by use of the die 11 composed of the resin plate 11A and the resin plate support 11B, and the above-mentioned resin molding apparatus 14. Each of the thus formed resin lines 13 has a predetermined thickness corresponding to the cross-section of each of the through-holes 11*a* formed in the resin plate 11A. At this moment, it is possible to make the resin lines 13 thinner by stretching the resin lines 13 as the resin lines 13 are being pulled out of the above-mentioned die 11.

Thus, the above-mentioned resin lines 13 can be made so as to be in a predetermined arrangement and to have a predetermined thickness as desired by use of the extruding method and the stretching method in combination, or one of the extruding method or the stretching method, using the above-mentioned die 11.

The through-holes 11*a* to be formed in the above-mentioned resin plate 11A can be formed so as to have any diameter as desired, so that a predetermined number of resin lines 13 can be made relatively easily so as to be in a predetermined arrangement and to have a predetermined thickness, for example, in the order of several microns.

Figure 3B:
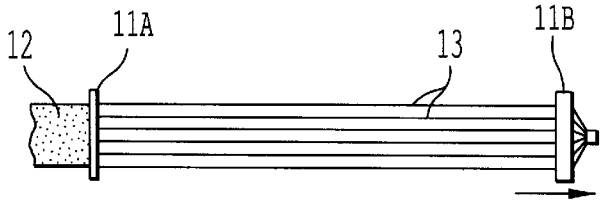

After forming a necessary number of resin lines 13 with a predetermined thickness en bloc, the above-mentioned resin plate 11A and the resin plate support 11B are separated from each other as shown in FIG. 3B. In order that an end portion of the bunch of the resin lines 13 on a pressure outlet side of the resin plate support 11B is prevented from coming out from the resin plate support 11B when the above-mentioned resin plate 11A and the resin plate support 11B are separated from each other, the end portion of the bunch of the resin lines 13 on the pressure outlet side of the resin plate support 11B is tied up and fixed by adhesion or fusing before the above separating operation is carried out.

Figure 8:
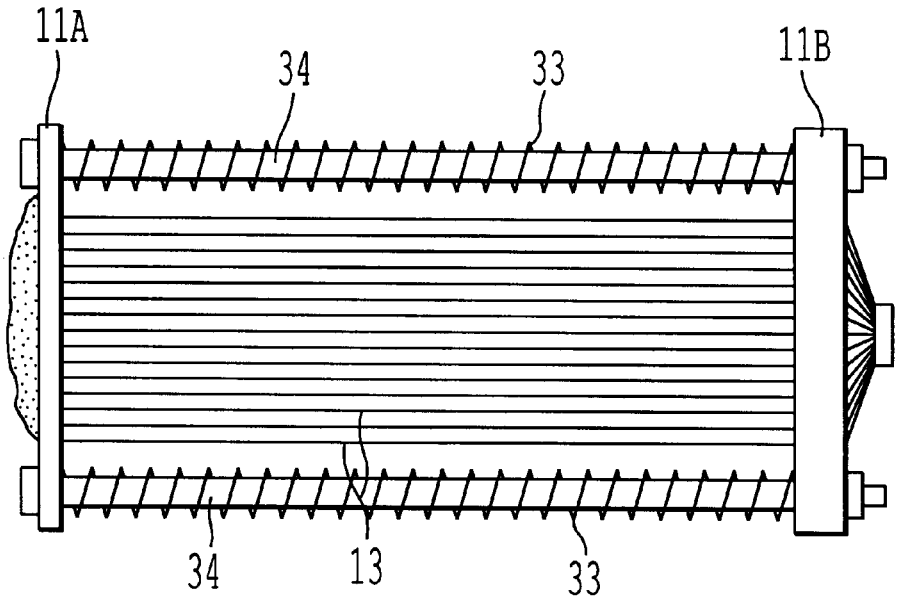
FIG. 8 is a schematic side view for explaining how to stretch the above-mentioned resin lines.

For instance, as shown in FIG. 8, a plurality of stays, each being equipped with a coil spring 33, is disposed between the resin plate 11A and the resin plate support 11B, and the above-mentioned resin lines 13 are stretched between the resin plate 11A and the resin plate support 11B by the expanding resilience of the coil spring 33. The expanding resilience of the coil spring 33 is adjusted to such a degree that the resin lines 13 stretched between the resin plate 11A and the resin plate support 11B are not broken by the expanding resilience of the coil spring 33, for instance, with the thickness of each of the resin lines 33 taken into consideration.

Figure 3C:
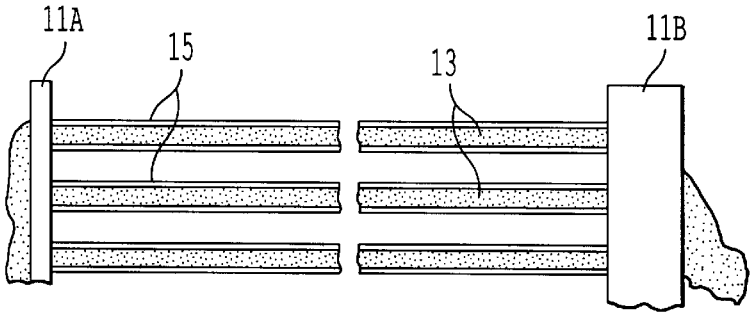

As shown in FIG. 3C, an electroconductive metal film 15 is deposited in vacuum on the surface of each of the resin lines 13 which are stretched between the resin plate 11A and the resin plate support 11B. It is preferable that the electroconductive metal film 15 be made of a metal with high resistance to corrosion.

It is also preferable that the vacuum deposition of the electroconductive metal film 15 on the surface of the resin lines 13 be conducted as the resin lines 13 are rotated. This is because by the above-mentioned vacuum deposition of the electroconductive metal film 15 on the resin lines 13 as the resin lines 13 are being rotated, the electroconductive metal film 15 can be uniformly deposited on the entire surface of each of the resin lines 13 and improper plating on the resin lines 13 can be avoided.

It is also preferable that the above-mentioned electroconductive metal film 15 be vacuum-deposited on the surface of the resin lines 13 by Ion Beam Assisted Deposition Method (hereinafter referred to as IBAD Method), since the fixing force of the electroconductive metal film 15 to the resin lines 13 can be significantly improved by the vacuum deposition using the IBAD Method.

Figure 3D:
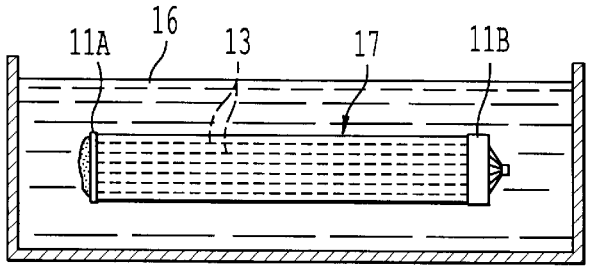

The resin lines 13, with the electroconductive metal film 15 being deposited thereon in a state of being stretched between the resin plate 11A and the resin plate support 11B, are then immersed in an electrolysis solution of a metal such as nickel, and subjected to plating treatment so as to conduct plating on the outer surface of the resin lines 13, whereby a nozzle substrate 17 made of the metal used in the plating is prepared as shown in FIG. 3D.

Figure 3E:
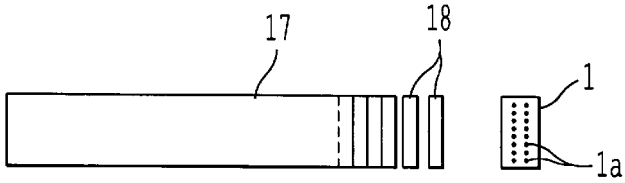

As shown in FIG. 3E, the above-mentioned nozzle substrate 17 is sliced, for instance, with a diamond cutter, to prepare nozzle chips 18 with a predetermined thickness. The surface of the thus prepared nozzle chips 18 is then abraded and/or polished. By slicing the nozzle substrate 17 or by abrading and/or polishing the nozzle chips 18 while the resin lines 13 are embedded in the nozzle substrate 17 or the nozzle chips 18, there can be prevented the formation of burrs in nozzle holes 1*a* which are formed after the removal of the resin lines 13 from the sliced nozzle substrates, despite the application of the slicing force thereto at the time of the slicing working, and the nozzle holes 1*a* are not deformed by shavings at the time of the abrasion or polishing working.

The nozzle chips 18 are then heated to high temperature to burn off the resin lines 13 embedded in each of the nozzle chips 18, and to remove the resin lines 13 from the nozzle chips 18, whereby a nozzle plate 1 is prepared. At this moment, by heating the nozzle chips 18 to high temperature in an atmosphere of oxygen or nitrogen, the nozzle chips 18 can be converted to nozzle chips 18 made of a metallic oxide or a metallic nitride with extremely high hardness.

In the case where there is no risk that burrs are formed in the nozzle holes 1*a*, or the nozzles holes 1*a* are deformed or broken during the slicing working and/or abrasion or polishing working of the nozzles substrate 17, the nozzle substrate 17 may be heated to high temperature to remove the resin lines 13 from the nozzle substrate 17, and a nozzle plate 1 with a predetermined thickness may be formed by slicing the nozzle substrate 17. When the resin lines 17 embedded in the nozzle chips 18 are relatively thick, the resin lines 17 may be extruded from the nozzle chips 18.

By burning off the resin lines 13 from the nozzle chips 18, there can be prepared the nozzle plate 1 with nozzles holes 1*a* of which cross-sectional shape, diameter and arrangement correspond to those of the above-mentioned resin lines 13.

The above-mentioned resin lines 13 are made of a resin prepared from a purified petroleum product, so that the resin lines 13 can be completely burnt off, without any residue, by the above-mentioned heating. Therefore, the nozzle holes 1*a* with a shape and an arrangement faithful to the cross-sectional shape and the arrangement of the resin lines 13 can be formed in the above-mentioned nozzle plate 1.

As mentioned above with reference to FIG. 3C, by depositing the electroconductive metal layer 15 in vacuum on the surface of the resin lines 13, using a metal with high resistance to corrosion, the corrosion with an ink of the nozzle holes 1*a* formed in the nozzle plate 1 can be prevented, so that the life of the nozzle plate 1 can be lengthened.

Furthermore, the nozzle plate 1 prepared by slicing the nozzle substrate 17 made of the above-mentioned metal, and removing the resin lines 13 from the nozzle substrate 17, can also be employed as the die 11 for forming the above-mentioned resin lines 13.

Thus, by using the nozzle plate 1 made of the above-mentioned metal as the die 11 for forming the above-mentioned resin lines 13, the life of the die 11 can be lengthened. Further, by using the nozzle plate 1 made of the metal as the die 11, the resin lines 13 extruded from the die 11 can be directly stretched without difficultly, and the resin lines 13 can be made thin, and the strength thereof can also increased at the same time.

Japanese Patent Application No. 10-166266, filed May 29, 1998, is hereby incorporated by reference.

What is claimed is:

1. A method of producing a nozzle plate having nozzle holes for use in an ink jet head, comprising the steps of:

stretching a predetermined number of resin lines, each having a cross section corresponding in shape to each of said nozzle holes of said nozzle plate in the same arrangement as that of said nozzle holes of said ink jet head, plating the peripheral surface of each of said resin lines with a metal, while maintaining the arrangement of said resin lines, forming a nozzle substrate so as to include said resin lines therein with said metal used in the plating of said resin lines, subsequently slicing said nozzle substrate, and then removing said resin lines from said sliced nozzle substrate, thereby forming said nozzle plate.

2. The method as claimed in claim 1, wherein there is constructed a die comprising (a) a resin plate in which through-holes for extruding said resin lines therefrom are formed so as to correspond to the nozzle holes of said ink jet head in terms of the number, the shape and the arrangement thereof, and (b) a resin plate support for supporting said resin plate when said resin lines are extruded from said through-holes of said resin plate, said resin plate support having openings corresponding to said through-holes formed in said resin plate in terms of the number and the arrangement thereof, having a diameter with the same as or greater than the diameter of said through-holes formed in said resin plate, and said predetermined number of said resin lines are prepared by extruding a viscous resin from said die.

3. The method as claimed in claim 2, wherein said resin plate and said resin plate support are constructed so as to be separable from each other, further comprising the step of:

depositing an electroconductive metal film in a vacuum on the surface of said resin lines prior to the step of plating the peripheral surface of each of said resin lines with said metal, with said predetermined number of said resin lines being stretched between said resin plate and said resin plate support.

4. A method of producing a nozzle plate having nozzle holes for use in an ink jet head, comprising the steps of:

stretching a predetermined number of resin lines, each having a cross section corresponding in shape to each of said nozzle holes of said nozzle plate in the same arrangement as that of said nozzle holes of said ink jet head, plating the peripheral surface of each of said resin lines with a metal, while maintaining the arrangement of said resin lines, forming a nozzle substrate so as to include said resin lines therein with said metal used in the plating of said resin lines, subsequently removing said resin lines from said nozzle substrate, and then slicing said nozzle substrate, thereby forming said nozzle plate.

5. The method as claimed in claim 4, wherein there is constructed a die comprising (a) a resin plate in which through-holes for extruding said resin lines therefrom are formed so as to correspond to the nozzle holes of said ink jet head in terms of the number, the shape and the arrangement thereof, and (b) a resin plate support for supporting said resin plate when said resin lines are extruded from said through-holes of said resin plate, said resin plate support having openings corresponding to said through-holes formed in said resin plate in terms of the number and the arrangement thereof, having a diameter with the same as or greater than the diameter of said through-holes formed in said resin plate, and said predetermined number of said resin lines are prepared by extruding a viscous resin from said die.

6. The method as claimed in claim 5, wherein said resin plate and said resin plate support are constructed so as to be separable from each other, further comprising the step of:

depositing an electroconductive metal film in a vacuum on the surface of said resin lines prior to the step of plating the peripheral surface of each of said resin lines with said metal, with said predetermined number of said resin lines being stretched between said resin plate and said resin plate support.

7. A method of producing a nozzle plate having a predetermined number of through-holes with a predetermined cross section in a predetermined arrangement, comprising the steps of:

stretching the same number of resin lines as that of said through-holes to be formed in said nozzle plate, each having a cross section in the same shape as that of the cross section of said through-holes to be formed in said nozzle plate, in the same arrangement as that of said through-holes to be formed in said nozzle plate, with each of said resin lines being out of contact with each other, making at least the surface of said resin lines electroconductive with said arrangement of said resin lines being maintained, plating the surface of said resin lines with a metal to grow the plating with said metal until a nozzle substrate in which said resin lines are embedded therein is formed, slicing said nozzle substrate so as to prepare sliced nozzle substrates in which sliced resin lines are embedded, and removing said sliced resin lines from said sliced nozzle substrates, thereby forming said nozzle plate.

8. The method as claimed in claim 7, wherein said resin lines are formed by extruding a viscous resin from a die having the same number of through-holes with a cross section in the same shape as those of said through-holes to be formed in said nozzle plate in said same predetermined arrangement.

9. The method as claimed in claim 8, wherein said die comprises:

a resin plate having the same number of through-holes with a cross section in the same shape as those of said through-holes to be formed in said nozzle plate in said same predetermined arrangement, and a resin plate support for supporting said resin plate when said resin lines are extruded from said through-holes of said resin plate, said resin plate support having openings corresponding to said through-holes formed in said resin plate in terms of the number and the arrangement thereof, having a diameter with the same as or greater than the diameter of said through-holes formed in said resin plate.

10. The method as claimed in claim 9, wherein said said resin plate and said resin plate support are separable from each other and can be positioned in such a posture that said resin lines can be stretched between said resin plate and said resin plate support.

11. The method as claimed in claim 8, wherein said die comprises said nozzle plate as produced by the method as claimed in claim 7.

12. The method as claimed in claim 7, wherein at least the surface of said resin lines is made electroconductive by depositing an electroconductive material thereon.

13. The method as claimed in claim 7, wherein said sliced resin lines are removed from said sliced nozzle substrates by burning.

14. The method as claimed in claim 7, further comprising a step of subjecting said nozzle plate to heat treatment in an atmosphere of oxygen or in an atmosphere of nitrogen.

15. The method as claimed in claim 12, wherein said electroconductive method is titanium.

16. The method as claimed in claim 7, wherein said metal used for plating the surface of said resin lines is selected from the group consisting of Ni and Al.

17. A method of producing a nozzle plate having a predetermined number of through-holes with a predetermined cross section in a predetermined arrangement, comprising the steps of:

stretching the same number of resin lines as that of said through-holes to be formed in said nozzle plate, each having a cross section in the same shape as that of the cross section of said through-holes to be formed in said nozzle plate, in the same arrangement as that of said through-holes to be formed in said nozzle plate, with each of said resin lines being out of contact with each other, and at least the surface of said resin lines being electroconductive, plating the surface of said resin lines with a metal to grow the plating with said metal until a nozzle substrate in which said resin lines are embedded therein is formed, slicing said nozzle substrate so as to prepare sliced nozzle substrates in which sliced resin lines are embedded, and removing said sliced resin lines from said sliced nozzle substrates, thereby forming said nozzle plate.

18. The method as claimed in claim 17, wherein said resin lines are formed by extruding a viscous resin from a die having the same number of through-holes with a cross section in the same shape as those of said through-holes to be formed in said nozzle plate in said same predetermined arrangement.

19. The method as claimed in claim 18, wherein said die comprises:

a resin plate having the same number of through-holes with a cross section in the same shape as those of said through-holes to be formed in said nozzle plate in said same predetermined arrangement, and a resin plate support for supporting said resin plate when said resin lines are extruded from said through-holes of said resin plate, said resin plate support having openings corresponding to said through-holes formed in said resin plate in terms of the number and the arrangement thereof, having a diameter with the same as or greater than the diameter of said through-holes formed in said resin plate.

20. The method as claimed in claim 19, wherein said resin plate and said resin plate support are separable from each other and can be positioned in such a manner that said resin lines can be stretched between said resin plate and said resin plate support.

21. The method as claimed in claim 18, wherein said die comprises said nozzle plate as produced by the method as claimed in claim 17.

22. The method as claimed in claim 17, wherein said sliced resin lines are removed from said sliced nozzle substrates by burning.

23. The method as claimed in claim 17, further comprising a step of subjecting said nozzle plate to heat treatment in an atmosphere of oxygen or in an atmosphere of nitrogen.

* * * * *

UNITED STATES PATENT AND TRADEMARK OFFICE

CERTIFICATE OF CORRECTION

PATENT NO. : 6,256,883 B1
DATED : July 10, 2001
INVENTOR(S) : Makoto Kinoshita

It is certified that error appears in the above-identified patent and that said Letters Patent is hereby corrected as shown below:

Column 8,
Line 60, insert -- be -- after "can".

Column 11,
Line 8, delete "nozzles" and insert -- nozzle --;
Line 10, delete "nozzles" and insert -- nozzle --;
Line 48, insert -- be -- after "also".

Column 13,
Line 40, delete first occurrence "said";
Line 58, delete "method" and insert -- material --.

Signed and Sealed this

Eleventh Day of June, 2002

*Attest:*

*Attesting Officer*

JAMES E. ROGAN
*Director of the United States Patent and Trademark Office*